US007487570B2

(12) United States Patent
Kim et al.

(10) Patent No.: US 7,487,570 B2
(45) Date of Patent: Feb. 10, 2009

(54) APPARATUS FOR PROTECTING MOTOR OF A VACUUM CLEANER

(75) Inventors: Tak-soo Kim, Gwangju (KR); Hyoung-min Cho, Seoul (KR); Doo-han Yang, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 306 days.

(21) Appl. No.: 11/389,215

(22) Filed: Mar. 27, 2006

(65) Prior Publication Data

US 2006/0265834 A1 Nov. 30, 2006

(30) Foreign Application Priority Data

May 30, 2005 (KR) ..... 10-2005-0045555

(51) Int. Cl.
*A47L 9/22* (2006.01)

(52) U.S. Cl. ..... 15/412; 15/413

(58) Field of Classification Search ..... 15/422, 15/423; *A47L 9/22*
See application file for complete search history.

(56) References Cited

U.S. PATENT DOCUMENTS

2005/0050679 A1 3/2005 Jeon

FOREIGN PATENT DOCUMENTS

| | | |
|---|---|---|
| DE | 86 15 755 | 10/1987 |
| EP | 1 514 505 | 3/2005 |
| JP | 52-138432 U | 10/1977 |
| JP | 53-105140 U | 9/1978 |
| JP | 55-078864 | 6/1980 |
| JP | 63-115964 U | 7/1988 |
| JP | 63-125264 U | 8/1988 |
| JP | 05 253101 | 10/1993 |
| JP | 09-004729 | 1/1997 |
| JP | 2005-081144 | 3/2005 |
| KR | 10-2003-0031575 | 4/2003 |
| KR | 10-2005-0026163 | 3/2005 |
| RU | 2197167 | 1/2003 |
| RU | 2236638 | 9/2004 |
| SU | 89413 | 2/1950 |

OTHER PUBLICATIONS

European Patent Office, Search Report issued Jun. 26, 2007, with respect to European Patent Application 06290773.8.

*Primary Examiner*—David A Redding
(74) *Attorney, Agent, or Firm*—Blank Rome LLP

(57) ABSTRACT

A motor protection apparatus for a vacuum cleaner includes: a motor chamber adapted to mount a motor; a penetration hole formed on a partition surrounding the motor chamber; a valve member configured to move between a first position closing the penetration hole and a second position at a distance from the penetration hole; and a casing adapted to be connected to an inner wall of the partition to surround the valve member and to guide movement of the valve member. A casing distance between an inner circumference of the casing and the valve member is minimized when the valve member is in the first position and maximized when the valve member is in the second position.

16 Claims, 6 Drawing Sheets

APPARATUS FOR PROTECTING MOTOR OF A VACUUM CLEANER

CROSS-REFERENCE TO RELATED APPLICATIONS

This application claims the benefit of priority under 35 U.S.C. § 119 to Korean Patent Application No. 2005-45555, filed May 30, 2005, the entire contents of which are incorporated herein by reference.

BACKGROUND OF THE INVENTION

1. Field of the Invention

The present invention relates to a vacuum cleaner. More particularly, the present invention relates to a motor protection apparatus for a vacuum cleaner, which prevents damage to the motor by restraining overloading of the motor that generates a suction force.

2. Description of the Related Art

In general, a motor is provided in a vacuum cleaner to generate a suction force at a dust suction port. The motor is typically mounted in a motor chamber sectioned by partitions formed in the vacuum cleaner. While the motor is driven, a certain amount of air is generally continuously supplied to the motor to cool the motor. Also, the air supply prevents overloading of the motor, thereby ensuring stable driving of the motor. However, when the dust suction port is blocked by collected dust or when a dust collecting apparatus becomes full, the air cannot be drawn in enough to cool the motor. In this case, the motor may be overheated and damaged.

SUMMARY OF THE INVENTION

An aspect of the present invention is to solve at least the above problems and/or disadvantages and to provide at least the advantages described below.

To this end, a first non-limiting aspect of the invention provides a motor protection apparatus for a vacuum cleaner that includes: a motor chamber adapted to mount a motor; a penetration hole formed on a partition surrounding the motor chamber; a valve member configured to move between a first position closing the penetration hole and a second position at a distance from the penetration hole; and a casing adapted to be connected to an inner wall of the partition to surround the valve member and to guide a movement of the valve member, wherein a casing distance between an inner circumference of the casing and the valve member is minimized when the valve member is in the first position and is maximized when the valve member is in the second position.

Another aspect of the invention provides a motor protection apparatus for a vacuum cleaner, which includes: a motor chamber; a penetration hole formed at the motor chamber; a valve member positioned proximate to the penetration hole and configured to open and close to enable air flow to the motor chamber such that air is substantially continuously supplied to the motor chamber.

BRIEF DESCRIPTION OF THE DRAWINGS

The above aspects and other features of the present invention will become more apparent by describing in detail exemplary embodiments thereof with reference to the attached drawing figures, wherein.

DETAILED DESCRIPTION OF THE EMBODIMENTS

Figure 1:
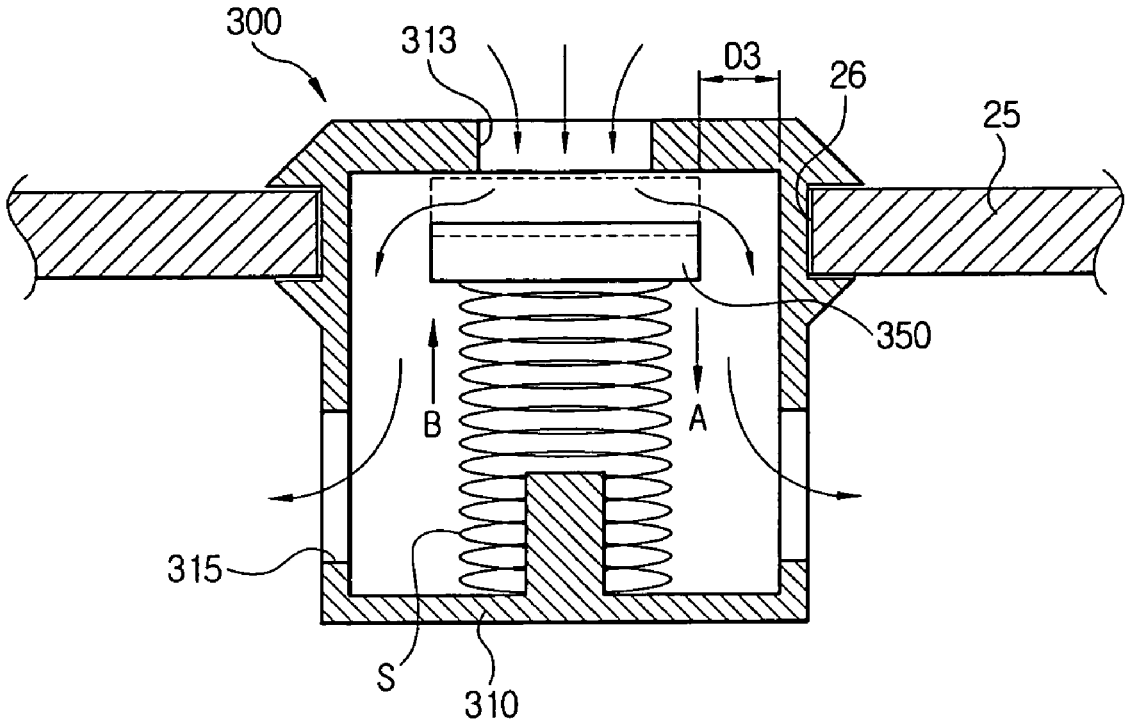
FIG. 1 shows an exemplary motor protection apparatus.

Hereinafter, certain embodiments of the present invention will be described in detail with reference to the accompanying drawing figures. In the following description, the same drawing reference numerals are used for the same elements even in drawings showing different embodiments.

In order to prevent damage to the motor, a motor protection apparatus may be used. The motor protection apparatus may be configured to draw air from the outside into the motor chamber when air pressure inside the motor chamber drops below a predetermined level. FIG. 1 shows an example of this motor protection apparatus. Referring to FIG. 1, the motor protection apparatus 300 may include a casing 310, which may be mounted through a mounting hole 26 formed on a partition 25 that may sectionally define the motor chamber, a valve member 350 opening and closing a penetration hole 313 formed on the casing 310, and a resilient body S biasing the valve member 350 in a direction for closing the penetration hole 313. According to this configuration, when the air pressure inside the motor chamber is less than a predetermined level, the valve member 350 may be moved in the direction of arrow direction A by a pressure difference between the inside and the outside of the motor chamber. Accordingly, air outside the motor chamber may be drawn into the motor chamber by passing through penetration hole 313 and discharge hole 315. The inner pressure of the motor chamber increases and therefore, the valve member 350 moves in the direction of B arrow by spring S, thereby closing the penetration hole 313.

Such recovery of the inner pressure of the motor chamber should be achieved promptly in order to effectively protect the motor. For this purpose, in the motor protection apparatus 300, a distance D3 between an inner wall of the casing 310 and the valve member 350 may be configured so that sufficient air can be supplied to the inside of the motor chamber as the valve member 350 moves. According to this, although the valve member 350 moves a little bit in a direction for opening the penetration hole 313 (the direction A of FIG. 1), a sufficient amount of air can flow into the casing 310 to thereby recover the inner pressure of the motor chamber. In this case, position of the valve member 350 is maintained, as minutely deviated from the penetration hole 313. However, if the inner pressure of the motor chamber is recovered temporarily, the valve member 350 may not be able to maintain its position but may be moved in the direction of arrow B (FIG. 1), thereby prematurely closing the penetration hole 313. When the inner pressure of the motor chamber drops in the above-identified configuration, inner pressure may not be recovered even when driving of a vacuum cleaner. Therefore, the motor can be protected as long as the penetration hole 313 is kept open until the factors causing the pressure drop are removed. However, in the motor protection apparatus having the sensitively operated valve member 350 as described above, although the penetration hole 313 is opened, the penetration hole 313 is soon closed even by temporary recovery of the inner pressure of the motor chamber. As opening and closing of the penetration hole 313 is thus repeated, cooling efficiency for the motor is deteriorated. Furthermore, noise may be generated by contact between the partitions and the valve member 350.

Figure 2:
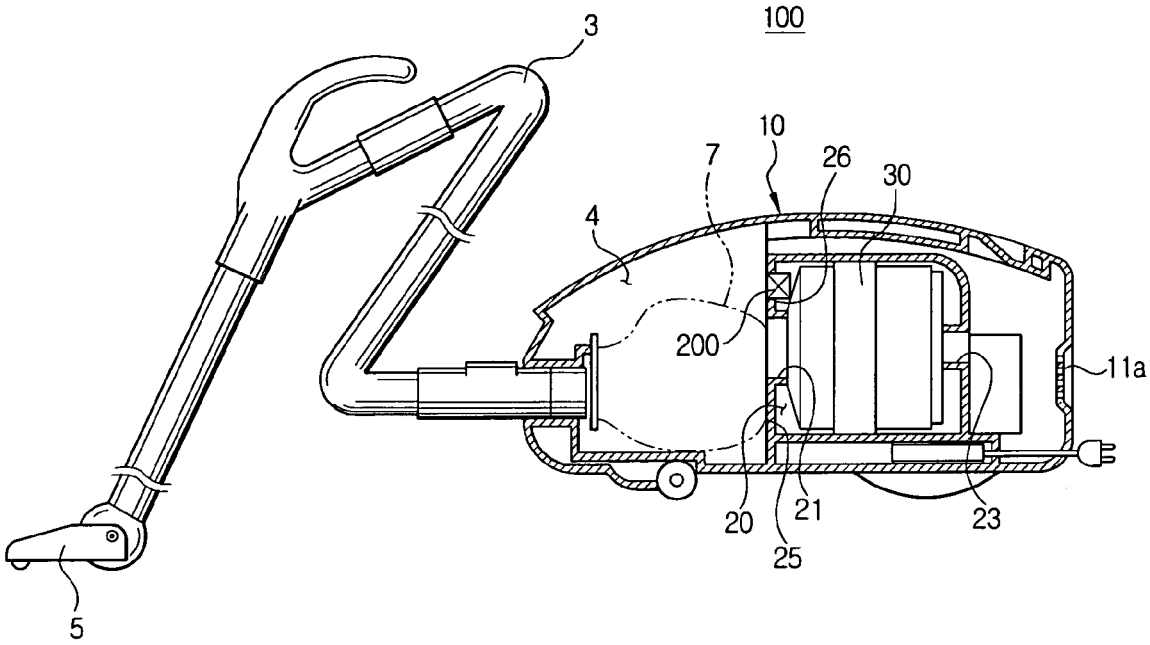
FIG. 2 shows a vacuum cleaner including a motor protection apparatus according to a non-limiting first embodiment of the present invention.
Figure 3:
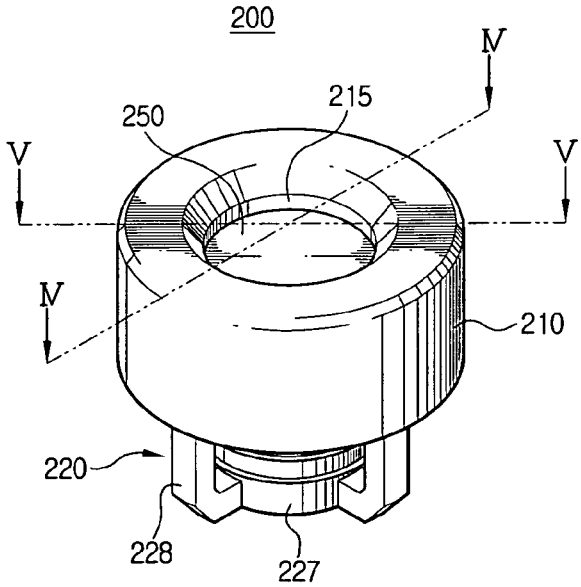
FIG. 3 is a perspective view of the motor protection apparatus according to the first non-limiting embodiment of the present invention.
Figure 4:
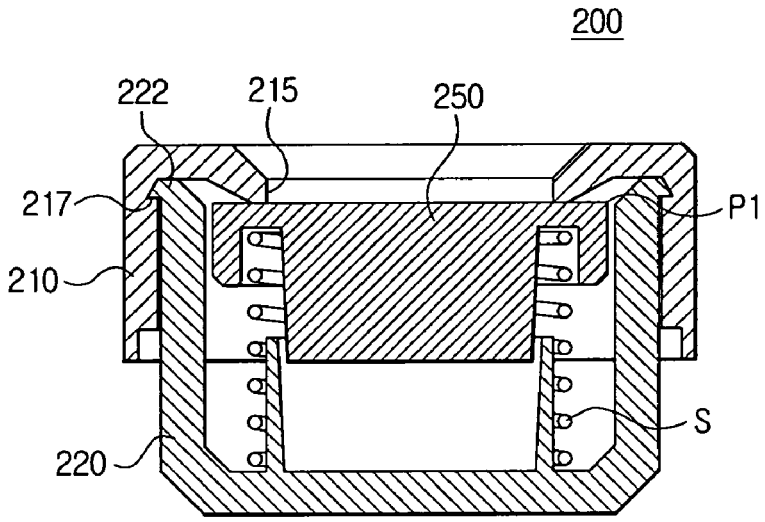
FIG. 4 is a sectional view of the motor protection apparatus cut along line IV-IV.

Referring to FIG. 2, a vacuum cleaner 100 according to a first non-limiting embodiment of the present invention may include a suction port assembly 5 and a cleaner body 10. The cleaner body 10 may include a motor chamber 20 including a motor 30 for generating a suction force at the suction port assembly 5 and a dust collecting chamber 4 mounting a dust collector 7 for separating dust from air drawn in through the suction port assembly 5. A reference numeral 3 denotes a connection member that may be configured to enable fluid communication between the suction port assembly 5 and cleaner body 10.

The motor chamber 20 may be formed inside the cleaner body 10, and may be defined by a partition 25. The partition 25 may include a main suction hole 21 connected with the dust collecting chamber 4, a discharge hole 23 connected to a discharge port 11 a penetratingly formed outside of the cleaner body 10, and a mounting hole 26 for drawing the outside air into the motor chamber 20 separately from the air being drawn in through the main suction hole 21. The dust collecting chamber 4 may be provided when the dust collector 7 is mounted within the cleaner body 10. In other words, when the dust collector 7 is formed outside of the cleaner body 10, the dust collecting chamber 4 can be omitted. In this case, the main suction hole 21 may fluidly communicate with the suction port assembly 5, and the mounting hole 26 may be configured to draw in the air from the outside of the motor chamber 20.

At the mounting hole 26, a motor protection apparatus 200 may be provided to draw in air from the dust collecting chamber 4 when air pressure inside the motor chamber 20 decreases. When the inner pressure of the motor chamber 20 drops below a desired level, the motor protection apparatus 200 may cause the outside air to be drawn in through the mounting hole 26. In the non-limiting present embodiment, the mounting hole 26 enables fluid communication between the dust collecting chamber 4 and the motor chamber 20.

Referring to FIGS. 3 through 7, the motor protection apparatus 200 according to a first non-limiting embodiment of the present invention may include a cover member 210, a casing 220, a valve member 250, and a resilient member, such as spring S. The cover member 210 may be mounted at the mounting hole 26 by a connection unit (not shown) and may include a penetration hole 215 connecting the inside and the outside of the motor chamber 20. For example, the penetration hole 15 may be located at a center of the motor chamber 20.

Figure 5:
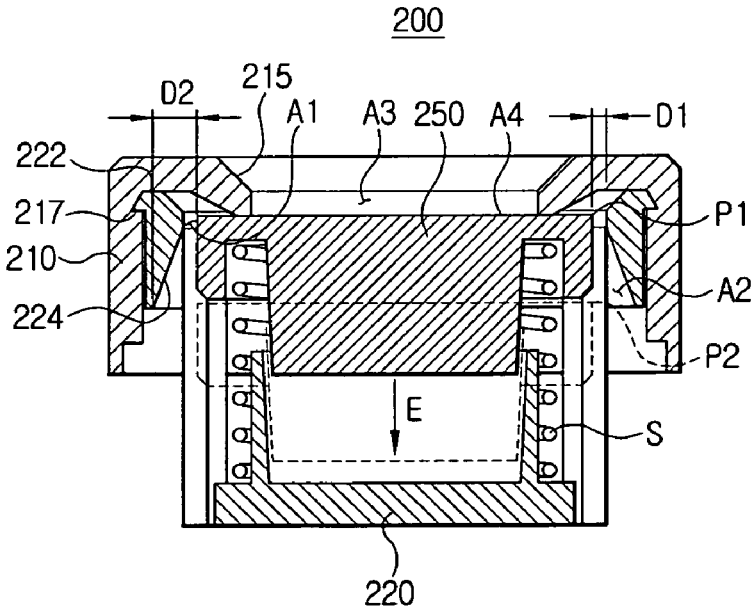
FIG. 5 is a sectional view of the motor protection apparatus cut along line V-V.

The valve member 250 may be mounted to move between a first position P1 (FIG. 5) and a second position P2 (FIG. 5). In the first position P1, the valve member 250 may be in contact with an inner circumference of the cover member 210 so that the penetration hole 215 is closed. In the second position P2, the valve member 250 may be disposed adjacent to a support part 227 of the casing 220 that will be described hereinafter. The valve member 250 may be resiliently supported toward the first position P1 by the spring S. Therefore, when the inner pressure of the motor chamber 20 drops below the desired level, the valve member 250 may be moved to the second position P2 to open the penetration hole 215. When the inner pressure of the motor chamber 20 increases above the desired level, the valve member 250 may return to the first position P1. Such movement of the valve member 250 may be generated by a pressure difference between the inside and the outside of the motor chamber 20. A sectional area A4 of the valve member 250, in this embodiment, may be larger than a sectional area A3 of the penetration hole 215 so that the pressure difference can be may be effectively utilized. If the sectional area A4 of the valve member 250 is too large, a volume of the motor protection apparatus 200 in the motor chamber 20 may increase too much, thereby hindering convenient mounting of the motor 30. On the other hand, if the sectional area A3 of the penetration hole 215 is too small compared to the sectional area A4 of the valve member 250, the valve member 250 cannot be moved smoothly by the air passing through the penetration hole 215. Therefore, a size of the valve member 250 may be determined based at least in part on these factors. Accordingly, in this embodiment, a ratio of the sectional area A4 of the valve member 250, being perpendicular to a direction of air current inside the penetration hole 215, to the inner sectional area A3 of the penetration hole 215 preferably satisfies [Expression 1] as follows. According to the present embodiment, the area ratio (A4/A3) may be approximately 1.5.

$$1 < \frac{A4}{A3} \leq 3 \qquad \text{[Expression 1]}$$

The casing 220 may include connection part 221, support part 227, and rib 228. The support part 227 may support the spring S and may be connected to the connection part 221 by at least one rib 228 extended from an outer circumference thereof. In more detail, air may flow through ribs 228 to the motor chamber 20 from a side surface of the valve member 250 to flow to motor chamber 20. A hook member 222 may protrude from an outer circumference of the connection part 221 so that it may engage with a connection groove 217, which may be formed on the inner circumference of the cover member 210. In addition, a slanted surface 224 may be formed on an inner circumference 223 of the connection part 221.

The slanted surface 224 may be configured to be gradually distanced away from the valve member 250 as the valve member 250 moves from the first position P1 (closing the penetration hole 215) to the second position P2. As shown in FIG. 5, more specifically, when the valve member 250 is in the first position P1, a distance D1 between the slanted surface 224 and the valve member 250 may be minimized, and when the valve member 250 is moved in the direction of arrow E (FIG. 5) to the second position P2 (where an end of the slanted surface 224 and the valve member 250 face each other), a distance D2 between the slanted surface 224 and the valve member 250 may be maximized. Here, the distance D2 is preferably large enough to ensure sufficient air flow for cooling the motor 30 (FIG. 2). Also, the distance D2 may preferably be the same as the distance D3 between the valve member 350 (FIG. 1) and the casing 310 (FIG. 1), described above. In this embodiment, the distance D2 may be set to about 5 mm.

According to the above-described configuration, when a dust suction hole (not shown) of the motor chamber 20 or a path connected to the motor chamber 20 becomes blocked (for example, by dust from dust collector 7), and the inner pressure of the motor chamber 20 drops below a desired level, the valve member 250 may move in the direction of arrow E (FIG. 5). The valve member 250 may, in turn, apply pressure to spring S, due to the difference of pressure between the inside and the outside of the motor chamber 20.

Figure 6:
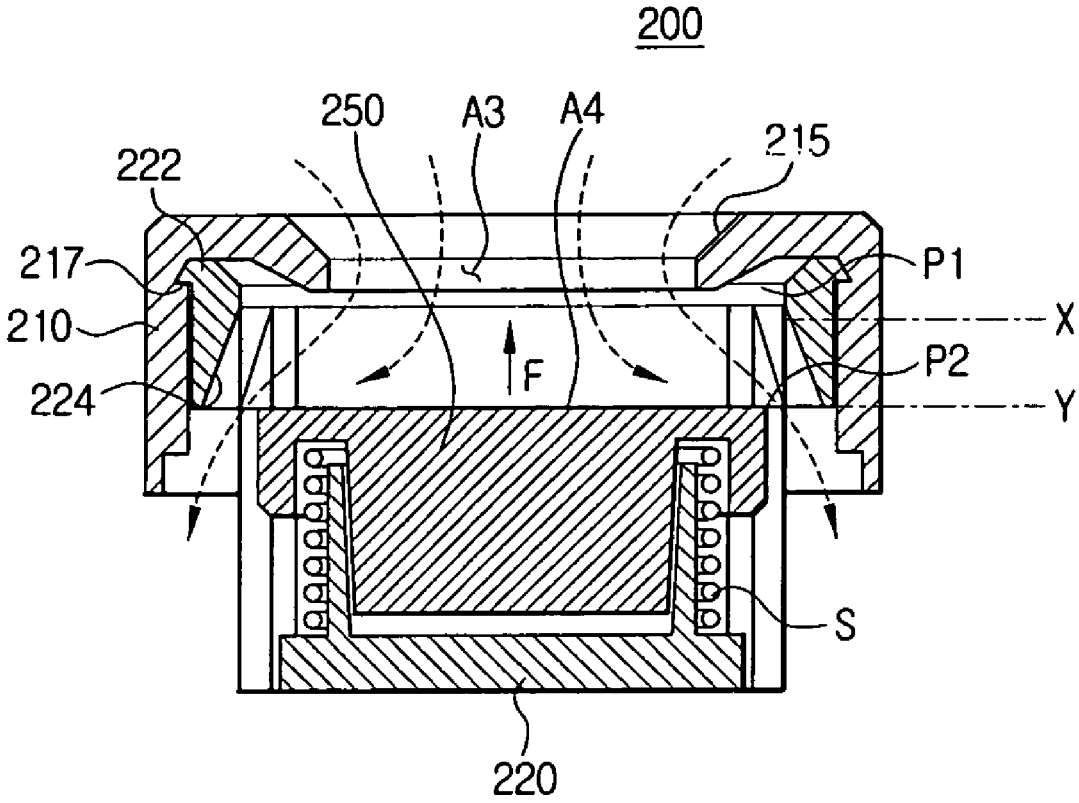
FIG. 6 is a sectional view showing the operation of the motor protection apparatus according to the first non-limiting embodiment of the present invention.
Figure 7:
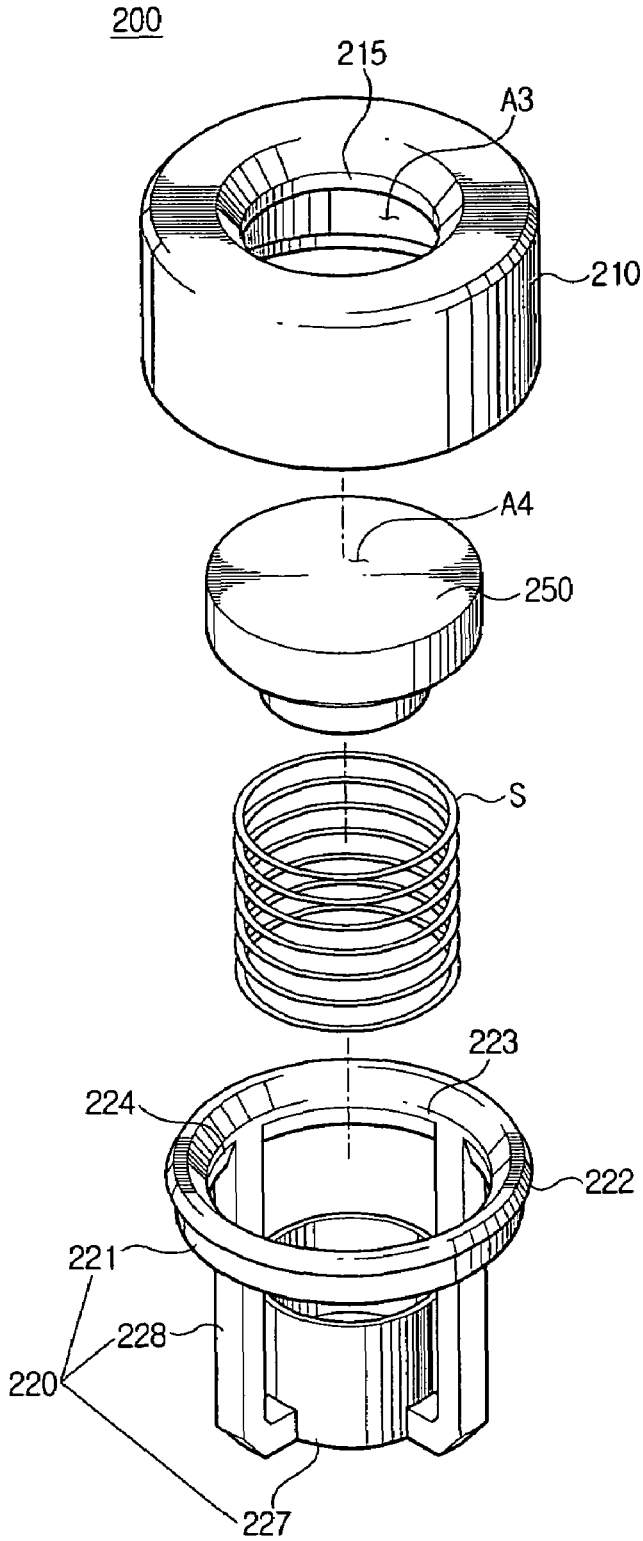
FIG. 7 is an exploded, perspective view of the motor protection apparatus according to the first non-limiting embodiment of the present invention.

Generally, the current speed of fluid is in inverse proportion to a sectional area of a passage the fluid passes through. In other words, the current speed of fluid is high when the sectional area is small, and low when the sectional area is large. Therefore, when the penetration hole 215 is opened, the air passing through a path formed around the side of the valve member 250 has higher current speed right before the valve member 250 reaches the first position P1 than when the valve member 250 is in the second position P2. Due to such differences in speed, movement of the valve member 250 may cease at the second position P2, where the distance between the valve member 250 and the slanted surface 224 favors air flow. When more than a certain amount of the outside air is drawn into the motor chamber 20 by the movement of the valve member 250, the inner pressure of the valve member 250 is recovered. Therefore, the valve member 250 may be raised by force from spring S in the direction of arrow F (FIG. 6). However, the distance between the slanted surface 224 and the valve member 250 gradually narrows as the valve member 250 raises, thereby increasing the current speed of the drawn-in air being passed through the side of the valve member 250 when the valve member 250 is moved. Such increase in the current speed of the air causes resistance along the direction of arrow E (FIG. 5), thereby reducing speed of the valve member 250 when moving toward the first position P1. Because the speed of the valve member 250 is reduced, if the inner pressure of the motor chamber 20 is decreased again while the valve member 250 is moving to the first position P1, the valve member 250 can move again to the second position P2 such that the valve member 250 and the cover member 210 do not contact each other.

In other words, if temporary recovery of the inner pressure of the motor chamber 20 is repeated in a state that a factor decreasing the inner pressure of the motor chamber 20 is not removed, the valve member 250 is not raised to the first position P1 due to the high speed of the drawn-in air current but may be reciprocated between an upper end X (FIG. 6) and a lower end Y (FIG. 6) of the slanted surface 224. As a result, the cooling operation for the motor 30 can be prevented from temporarily stopping due to temporary blocking of the penetration hole 215. Furthermore, noise generated by contact between the valve member 250 and the cover member 210 can be reduced. If the factor decreasing the inner pressure of the motor chamber 20 is completely removed, the valve member 250 may be continuously raised to reach the first position P1, and an upper side of the valve member 250, may block the penetration hole 215. As a result, flow of air through the penetration hole 215 may be stopped.

When the motor protection apparatus 200 is configured as described above, it may be preferable that a first sectional area A1 of a path formed between the valve member 250 9 disposed in the first position P10 and the slanted surface 224 and a second sectional area A2 of a path formed between the valve member 250 (disposed in the second position P2) and the slanted surface 224 are in certain a ratio for improving the effects of the slanted surface 224. In addition, when the distance D2 at the second position P2 of the valve member 250 is too great, volume of the motor protection apparatus 200 may be increased, thereby hindering convenient mounting of the motor 30. When the distance D2 is too small, on the other hand, difference in the distances D1 and D2 between the valve member 250 at the first and the second positions P1 and P2 and the slanted surface 224 are so minor that problems of the related art may not be improved. Accordingly, the ratio between the areas A1 and A2 may preferably satisfy [Expression 2] as follows:

$$1.2 < \frac{A2}{A1}. \qquad \text{[Expression 2]}$$

When the penetration hole 215 and the valve member 250 have the sizes described above and when the area ratio (A2/A1) is set to 2, the slanted surface 224 can be optimized.

The slanted surface 224 and the valve member 250 may have certain sizes to achieve the noise reduction effect by the slanted surface 224. For example, when the distance D1 between the valve member 250 at the first position P1 and the slanted surface 224 is greater than a predetermined value, the problems of the related art may not be improved. Therefore, the distance D1 between the valve member 250 at the first position P1 and the slanted surface 224 is preferably set to be smaller than about 10% of a diameter of the penetration hole 215 in order for the effect of the slanted surface 224. In this case, the above condition can be satisfied if the valve member 250 at the first position P1 is in contact with the slanted surface 224, thereby maximizing the effect of the slanted surface 224.

According to the above configuration, however, when the penetration hole 215 is closed, the contact between the slanted surface 224 and the valve member 250 may bring about noise and damage to parts. Therefore, the above configuration needs to be achieved in consideration of side effects, such as noise and damage. In the motor protection apparatus 200 according to the present non-limiting embodiment, an inner diameter of the penetration hole 215 is about 17 mm, an outer diameter of the valve member 250 is about 24 mm, the distance between the valve member 250 at the first position P1 and the slanted surface 224 is about 0.2 mm, thereby satisfying the above conditions and [Expression 1].

Figure 8:
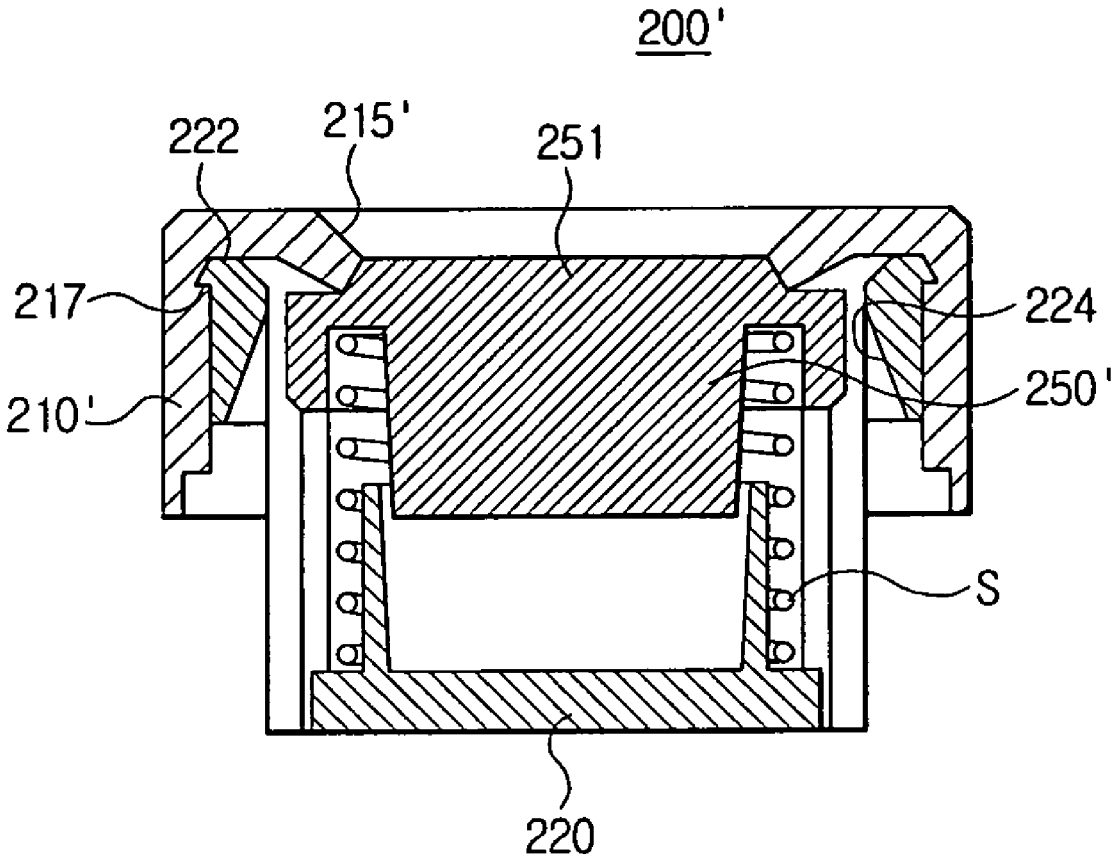
FIG. 8 is a sectional view of a motor protection apparatus according to a second non-limiting embodiment of the present invention.

FIG. 8 shows a motor protection apparatus according to a second non-limiting embodiment of the present invention. In the same manner as the first embodiment, the motor protection apparatus 200' of the present embodiment may include a cover member 210', the casing 220, a valve member 250', and a resilient member such as spring S. The connection part 224 of the casing 220 has the slanted surface 224. Differently from the first embodiment, in the second embodiment, the valve member 250' may further include an insertion part 251 and an inner circumference of a penetration hole 215' of the cover member 210' may be slanted in a corresponding form to the insertion part 251. Accordingly, since the insertion part 251 may be inserted in the penetration hole 215' as the penetration hole 215' is closed, the air outside the motor chamber 20 cannot flow into the motor chamber 20, thereby preventing deterioration of the suction performance of the motor. Also, in the motor protection apparatus 200' of this embodiment, the outer circumference of the insertion part 251 and the inner circumference of the slanted surface 224 may be slanted similar to each other. Therefore, when the penetration hole 215' is closed, the valve member 250' can be properly guided. In addition, almost the same effect of the slanted surface 224 of the previous embodiment can be obtained.

However, when the outer circumference of the insertion part 251 is thus slanted, the air flowing into the motor chamber 20 may be guided by the slanted insertion part 251 and may contact the valve member 250'. Accordingly, an external force applied to the valve member 250' may be diminished and the valve member 250' is moved only when the pressure difference is greater than a desired level. In this case, air suction operation for protecting the motor 30 may occur too late. Such a problem may be negligible when a size of the valve member 250' is large enough. However, when the vacuum cleaner 10 is limited in size and structure, the noise reduction effect by the slanted surface 224 of the casing 220 may be deteriorated. Therefore, application of the slanted surface 224 may consider various conditions and factors such as a size of the valve member 250'. Because other features of the second embodiment may be the same as or similar to features of the first non-limiting embodiment, a detailed description thereof is omitted.

As can be appreciated from the above description, according to non-limiting embodiments of the present invention, the inner circumference of the casing 220 may be formed so that a sectional area of a path formed around the side of the valve member 250 (250') increases when the valve member 250 (250') is moved to open the penetration hole 215 (215'). According to this, even while decrease and temporary recovery of the inner pressure of the motor chamber 20 is repeated, the penetration hole 215 (215') is not so frequently opened and closed as in the related art, thereby improving effects of cooling the motor and reducing noise.

While the invention has been shown and described with reference to certain non-limiting embodiments thereof, it will be understood by those skilled in the art that various changes in form and details may be made therein without departing from the spirit and scope of the invention as defined by the appended claims.

What is claimed is:

1. A motor protection apparatus for a vacuum cleaner, comprising:

a motor chamber adapted to mount a motor;

a penetration hole formed on a partition surrounding the motor chamber;

a valve member configured to move between a first position closing the penetration hole and a second position at a distance from the penetration hole; and a casing adapted to be connected to an inner wall of the partition to surround the valve member and to guide a movement of the valve member, wherein a casing distance between an inner circumference of the casing and the valve member is minimized when the valve member is in the first position and is maximized when the valve member is in the second position.

2. The motor protection apparatus of claim 1, wherein the inner circumference of the casing includes a slanted surface configured to gradually increase an inner diameter of the casing as the valve member is moved to the second position.

3. The motor protection apparatus of claim 2, wherein the casing comprises:

a connection part configured to be connected to the partition and to surround the valve member at a predetermined distance; and a support part configured to support the valve member at the second position and configured to be connected to the connection part by at least one rib member, wherein the slanted surface is formed on a part of the inner circumference of the connection part facing the valve member.

4. The motor protection apparatus of claim 3, wherein the connection part and the partition comprise a hook member and a connection groove, respectively, which are engaged with each other as the casing is connected.

5. The motor protection apparatus of claim 3, further comprising a resilient member disposed between the support part and the valve member, wherein the resilient member is transformed by pressure on the valve member when an inner air pressure of the motor chamber drops below a predetermined level.

6. The motor protection apparatus of claim 2, wherein a ratio between a second sectional area A2 of a path formed between the valve member disposed in the second position and the slanted surface and a first sectional area A1 of a path formed between the valve member disposed in the first position and the slanted surface satisfies the following expression:

$$1.2 < \frac{A2}{A1}.$$

7. The motor protection apparatus of claim 2, wherein the valve member comprises an insertion part configured to protrude from a first side of the valve member facing the penetration hole when disposed in the first position.

8. The motor protection apparatus of claim 7, wherein: an inner circumference of the penetration hole is slanted so that a sectional area at one end thereof increases toward the motor chamber, and an outer circumference of the insertion part is slanted corresponding to the inner circumference of the penetration hole.

9. The motor protection apparatus of claim 2, further comprising a cover configured to be mounted to a mounting hole formed on the partition for connecting the inside and the outside of the motor chamber, wherein the penetration hole is formed on the cover, and the casing is connected to the cover.

10. The motor protection apparatus of claim 1, wherein a ratio of a sectional area A4 of the valve member to a sectional area A3 of the penetration hole perpendicular to a direction of air flow through the penetration hole satisfies the following expression:

$$1 < \frac{A4}{A3} \leq 3.$$

11. The motor protection apparatus of claim 10, wherein the distance between the valve member disposed in the first position and the slanted surface is within 10% of an inner diameter of the penetration hole.

12. A motor protection apparatus for a vacuum cleaner, comprising:

a motor chamber adapted to mount a motor;

a mounting hole formed on a partition surrounding the motor chamber;

a valve member configured to move between a first position closing a penetration hole and a second position at a distance from the penetration hole;

a casing adapted to be connected to an inner wall of the partition to guide a movement of the valve member;

a cover member configured to be connected to the casing, the cover member having the penetration hole connecting the inside and the outside of the motor chamber; and a resilient member configured to resiliently support the valve member, wherein the casing comprises:

a connection part configured to be connected to the cover member;

a support part configured to support the resilient member; and at least one rib member configured to connect the connection part and the support part.

13. The motor protection apparatus of claim 12, wherein the at least one rib member is a plurality of rib members configured to be spaced apart from each other.

14. The motor protection apparatus of claim 13, wherein air flow through the penetration hole is stopped when the valve member is disposed in the first position, and air flow through a gap between the penetration hole and the plurality of rib members is maximized when the valve member is disposed in the second position.

15. The motor protection apparatus of claim 12, wherein the cover member comprises a connection groove into which the connection part of the casing is inserted.

16. The motor protection apparatus of claim 15, wherein the cover member is mounted at the mounting hole of the partition, and the casing is engaged with the connection groove of the cover member.

* * * * *